US006361047B1

(12) United States Patent
Militello

(10) Patent No.: US 6,361,047 B1
(45) Date of Patent: Mar. 26, 2002

(54) GAME AND METHOD HAVING POLARIZED ADHESION PORTIONS

(76) Inventor: Clif Militello, 81-70 Langdale St., New Hyde Park, NY (US) 11040

( * ) Notice: Subject to any disclaimer, the term of this patent is extended or adjusted under 35 U.S.C. 154(b) by 0 days.

(21) Appl. No.: 09/411,750

(22) Filed: Oct. 4, 1999

(51) Int. Cl.[7] ..... A63F 3/00

(52) U.S. Cl. ..... 273/239; 273/282.2; 273/282.1; 273/290; 273/291; 273/DIG. 30

(58) Field of Search ..... 273/282.2, 282.1, 273/290, 291, 348.4, DIG. 30, 239; 473/573

(56) References Cited

U.S. PATENT DOCUMENTS

| | | | | | |
|---|---|---|---|---|---|
| 2,282,871 | A | * | 5/1942 | Malbon | 273/290 |
| 3,895,804 | A | | 7/1975 | Lee | |
| 3,997,162 | A | | 12/1976 | Scullin | |
| 4,183,530 | A | | 1/1980 | Roop | |
| 4,205,850 | A | | 6/1980 | Craig | |
| 4,479,651 | A | | 10/1984 | La Fleur | |
| 4,552,361 | A | | 11/1985 | LaFleur | |
| 4,586,709 | A | | 5/1986 | Godinet | |
| 4,671,514 | A | | 6/1987 | Wilson-Diehl | |
| 4,699,385 | A | * | 10/1987 | Bifulco | 273/260 |
| 4,736,955 | A | * | 4/1988 | Pollock | 273/DIG. 30 |
| 4,842,194 | A | | 6/1989 | Halbert | |
| 4,863,176 | A | | 9/1989 | Lapkewych | |
| 4,915,394 | A | | 4/1990 | Kramer | |
| 4,938,485 | A | | 7/1990 | Hockridge | |
| 5,026,071 | A | | 6/1991 | Miraglia | |
| 5,062,381 | A | | 11/1991 | Hendricks | |
| 5,067,724 | A | | 11/1991 | Rinkavage | |
| 5,080,374 | A | | 1/1992 | Yu | |
| 5,199,715 | A | | 4/1993 | May | |
| 5,221,092 | A | | 6/1993 | Simons et al. | |
| 5,232,217 | A | | 8/1993 | Cota | |
| 5,250,000 | A | | 10/1993 | Boutin et al. | |
| RE34,461 | E | | 11/1993 | Buselli | |
| 5,324,042 | A | | 6/1994 | Demas | |
| 5,328,188 | A | * | 7/1994 | Brotz | 273/239 |
| 5,332,230 | A | | 7/1994 | Benedict | |
| 5,356,155 | A | | 10/1994 | Gross | |
| 5,482,295 | A | | 1/1996 | Phelan | |
| 5,540,440 | A | | 7/1996 | Liu | |
| 5,549,302 | A | | 8/1996 | Lapsker et al. | |
| 5,603,504 | A | | 2/1997 | Powell | |
| 5,613,687 | A | | 3/1997 | Zaffino | |
| 5,639,242 | A | | 6/1997 | Wilson | |
| 5,662,326 | A | * | 9/1997 | Gebran | 273/239 |
| 5,672,129 | A | | 9/1997 | Fisher et al. | |

FOREIGN PATENT DOCUMENTS

| | | | | |
|---|---|---|---|---|
| GB | 2082925 | * | 5/1982 | 273/DIG. 30 |

* cited by examiner

*Primary Examiner*—Benjamin H. Layno
(74) *Attorney, Agent, or Firm*—Milde, Hoffberg & Macklin, LLP

(57) ABSTRACT

A game system having a playing board which comprises one or more regions of polarized adhesion material, and a plurality of playing pieces, each with two faces, which may have polarized adhesion material of one or both types. The polarized adhesion material is preferably hook and loop fastener material. The game rules provide that playing pieces are deposited only where adhesion is strong, and may be stacked in accordance with this rule. Other rules are applied to define and differentiate game play. The game board is optionally reconfigurable, and may also have integrated electronics. The game board may include a foldable housing to contain the playing pieces when not in use.

34 Claims, 8 Drawing Sheets

GAME AND METHOD HAVING POLARIZED ADHESION PORTIONS

FIELD OF THE INVENTION

The present invention relates to a board device and associated elements which have defined attachment properties defined by physical properties of the elements and the board configuration, and more particularly to a game having game pieces which have polarization properties on surfaces thereof defining selective and variable attachment properties with respect to a board and other respective pieces.

BACKGROUND OF THE INVENTION

It is well known that attachment properties of elements may be made polar, i.e., having an acceptable orientation and an unacceptable orientation. Example technologies include magnets, hook and loop fasteners, and form-fitting topologies. Typically, such polarized attachment properties define a male and female configuration, and as known in the art, each element is either entirely male or entirely female, or each element is bipolar. Thus, in the example of a magnet, one side is "N" and the other side is "S". In the example of hook and loop fasteners, one side is hook and the other loop, or the entire surface is either hook or loop. In the case of form fitting, an example is "Lego(r)" blocks, which have an inherent polarity.

Typically, hook and loop fastener games include ballistic projectiles hurled at a target. In this case, the projectile has one polarity and the target the other polarity. For example, the projectile may be a standard-type tennis ball, which provides the loop material, and therefore the target is hook type material (See, U.S. Pat. Nos. 5,080,374, 4,863,176, and 5,221,092. See also U.S. Pat. Nos. 5,324,042, 5,549,302, 5,199,715, 5,332,230, and 4,938,485). In another example, a "dart" projectile has a leading surface with hook-type material, with a target having loop material (See, U.S. Pat. Nos. 3,997,162, and 4,183,530. See also U.S. Pat. No. Re. 34,461).

U.S. Pat. No. 5,639,242 relates to a board game in which repositionable playing pieces are adhered to a game board with hook and loop fastener material. U.S. Pat. No. 4,205,850 provides a puzzle game in which puzzle elements are held together and to a board with magnets or hook and loop fastener material.

U.S. Pat. No. 3,895,804 relates to a game board employing magnets or hook and loop fastener to hold the pieces in place.

U.S. Pat. No. 5,603,504 provides a word game in which letters are held to a board using hook and loop fasteners, having a ballistic component to game play.

U.S. Pat. No. 5,026,071 provides a word game in which includes an adherent game board surface for forming words using alphabetical letters.

U.S. Pat. No. 4,842,194 provides a toy road board for toy vehicles. Segments of the road are attached by means of hook and loop material strips.

U.S. Pat. Nos. 4,552,361 and 4,479,651 provide a jigsaw puzzle work board having a lid that is secured by hook and loop fastener material.

U.S. Pat. No. 5,232,217 relates to a game system having a hook and loop projectile target component.

In many instances, generating elements having a variety of polarity arrangements is difficult. For example, in magnetic systems, the close proximity of externally accessible opposite poles is difficult to achieve. In addition, systems that require various polarity relationships of an element are not well established.

SUMMARY OF THE INVENTION

The present in invention provides a set of elements, which provide a flexible polarity arrangement for purposes such as games and logical systems. According to the present invention, game pieces are provided having polarized faces which are independently selectable as male or female, for example in a two-faced game piece as male-male, male female or female-female. As such, there are three sets of game pieces, each with its own logical place within a game schema. A board is provided, for example with a predetermined polarity of locations for respective game pieces, providing a static environment for the stacking of polarized game pieces.

A preferred embodiment of the invention provides game pieces each having two faces, each face having a polarization of male or female. Each face, therefore, will selectively attach to a surface or another piece, depending on the polarization of the respective faces to be adjoined. Therefore, each side of each piece will selectively attach to the board or a respective piece depending on the nature of the presented surface.

Beside the preferred embodiment, it should be understood that other polarization schemes may be provided, to effect selective attachment properties. For example, ceramic magnetic sheet may be provided with particular magnetization patterns. When complementary patterns are presented, a force is generated adhering the surfaces together. On the other hand, where the patterns are incompatible, e.g., provide a net zero or repulsive force, the surfaces will not adhere. For example, linear and circular magnetization patterns are incompatible. It is noted that that, with respect to magnetic surfaces, a gap should be placed between surfaces of incompatible magnetic field patterns to avoid spatial cancellation.

Form fitting elements may also be provided with selective polarities on respective faces of an element. Thus, Lego(r) bricks are known with M-F, M-M, and presumably F-F arrangements. These pieces, however, are used as building blocks, and not as elements of a logical game or variable systematic representation.

Each game element may have two or more faces, for example having two or six (cubic) sides. Further, in the case of, for example, magnetic and form-fitting arrangements, it can be imagined that there may be a plurality of "polarities", thus providing for more complex logical interconnections.

Unlike the case of a flat disk, in which magnetic fields emanating from one face will interact and interfere with those from the other face, in the case of a cubic structure, opposing or adjacent faces may have arbitrary polarity. As discussed above, the magnetic "polarities" need not be simple N or S, but rather may be planar patterns of magnetic domains, thus providing a high degree of potential complexity.

Analogously, the polarized elements may be pin-in-socket connectors, which have both male and female types, with additional degrees of freedom in the number of pins. It is also possible to provide a hermaphroditic connector element, and a null element or terminator (no possible connection).

Therefore, it is understood that there are a number of alternatives to hook and loop fasteners, with somewhat different properties and advantages. In the context of a game or novelty, these particular properties may be useful for imparting a different feel or texture to the system, while achieving the same fundamental effects.

In accordance with one aspect of the invention, the pieces interact not only with a board, but also with each other, and therefore are selectively stackable in accordance with their respective face polarities. In the case of hook and loop fasteners, in a correct mating of opposite types of material, an adhesion will take place providing a substantial interlocking force, while when the same types of material touch there will be no or small adhesion forces.

Another aspect of the invention provides a game board, which is alterable or adaptive, providing for complex game play and/or game variations. Advantageously, the board therefore presents a surface compatible with the element adhesion system, with layout elements that also adhere to the surface. Therefore, the game system may have a large number of configurations and a respective large number of variations and sets of rules. Accessory pieces may be provided separately from the base game system to enhance and/or change the game play in the future.

One advantage of the adhesion properties of the pieces is that they facilitate use of the game in unstable environments, such as during travel. The game system may be provided as a solitaire system or for multiple simultaneous players.

The game board and layout structures, and potentially the game piece elements themselves, may be provided with color and/or graphic elements. Thus, game system may have, for example, character graphics or licensed character graphics, with game rules (and physical adhesion properties) coordinated with animate characteristics corresponding to the graphics.

Likewise, in its simplest iterations, the game system is quite economical, and therefore entire game systems or portions thereof may be promotional of a third party product or service. Thus, advertising graphics and potentially other marketing elements may be incorporated into the system.

The game system may also be "virtualized" as a computer 100' based game, represented in FIG. 6, although a physical implementation, as shown in FIG. 5 is preferred. Further, given the low costs associated with simple computer-based games, the game board or game system may include a computer system, including processor 100, power supply 101, input 102 and output 103. The output 103 comprises, for example, a liquid crystal display, while the input 104, 105, 106, 107, 108, 109, 110, 111 may comprise a set of dome switches, activated by finger depression or game piece placement. Where magnetic game pieces are provided, the input may comprise a magnetic sensor, and an output may comprise a magnetic coil, which attracts and/or repels the pieces. A LCD display is preferably also provided in this case.

These and other objects and features of the present invention will become more fully apparent from the following description and appended claims taken in conjunction with the accompanying drawings, in which like numerals refer to like parts.

DETAILED DESCRIPTION OF THE PREFERRED EMBODIMENTS

Figure 1:
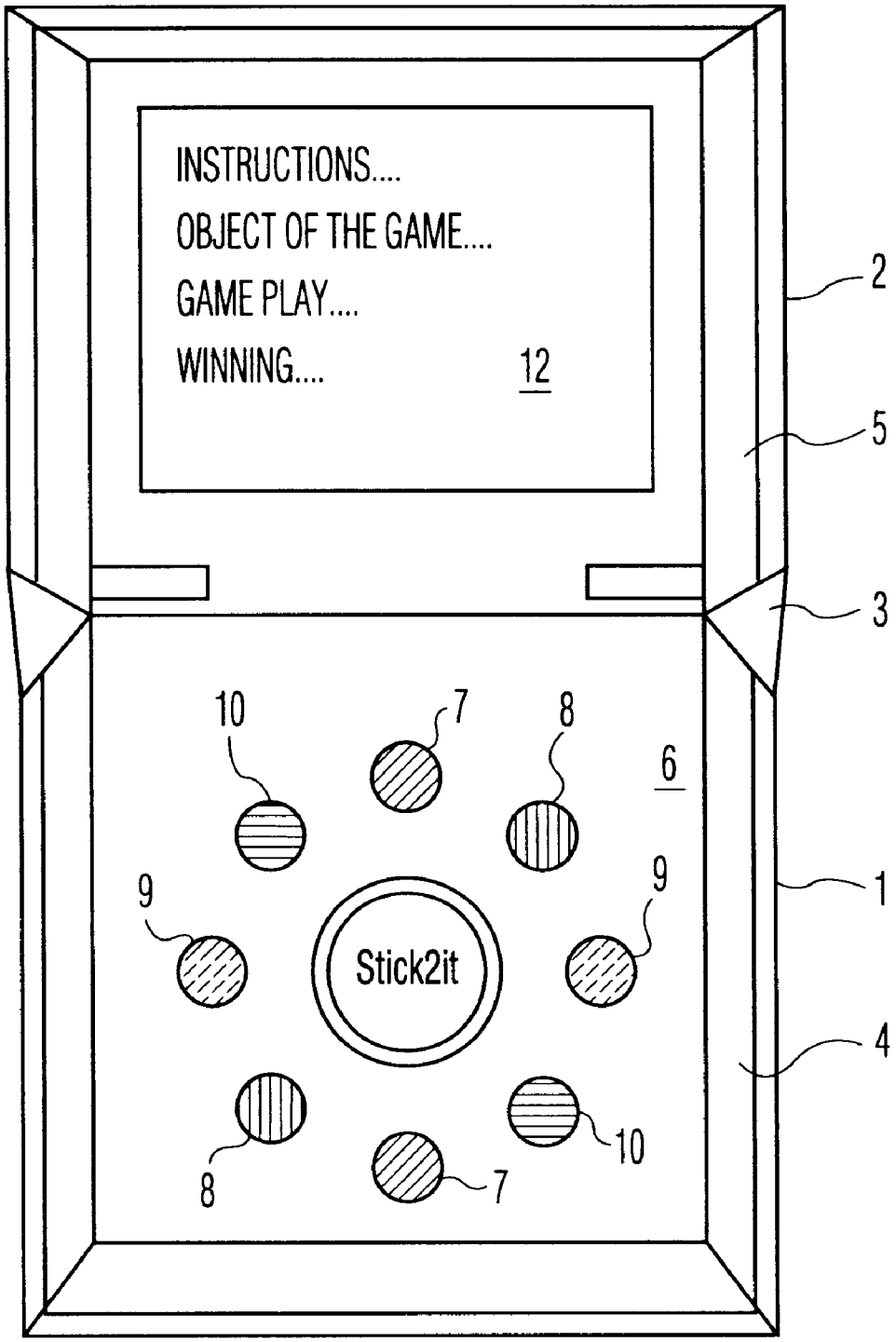
FIG. 1 shows a perspective view of one embodiment according to the present invention of a game board within a self-contained case.

The invention will now be described by way of the drawings, in which corresponding reference numerals indicate corresponding structures in the figures.

EXAMPLE 1

A hand held portable Travel Game packaged in a self contained plastic case provides a static board 6, consisting of a number of hook portions 7 and loop portions 8, 9, 10, of various colors, formed on the playing surface. The center of the board 6 is a convenient location for a graphic 11. For example, eight regions are formed on a flat surface in an octagonal arrangement, in the following order: tan loop 9; white loop 10; tan hook 7; black loop 8; tan loop 9; white loop 10; tan hook 7; and black loop 8. The board 6 is thus symmetric. The board 6 is preferably contained in a foldable case, facilitating storage and transport of the board and associated die and playing pieces. The case includes a base 1, a top 2, a hinge region 3, and interlocking sides 4, 5. The inner surface of the top 2 is an advantageous location for printed instructions 12. The game case is preferably formed of plastic, approximately 4 inches by 4 ½ inches by ¾ inch, in a clamshell design.

Eighteen playing pieces are provided: 9 black disks, provided as one pair each of black loop on both faces, tan hook on both faces, and black loop and tan hook on respective faces; and one each of tan loop on both faces, tan hook and tan loop on respective faces, and tan loop and black loop on respective faces. 9 white disks, provided as one pair each of white loop on both faces, tan hook on both faces, and white loop and tan hook on respective faces; and one each of tan loop on both faces, tan hook and tan loop on respective faces, and tan loop and white loop on respective faces. The disks are preferably clear or black plastic disks, approximately ⅝ inches in diameter and 3/32 inches thick.

Figure 2A:
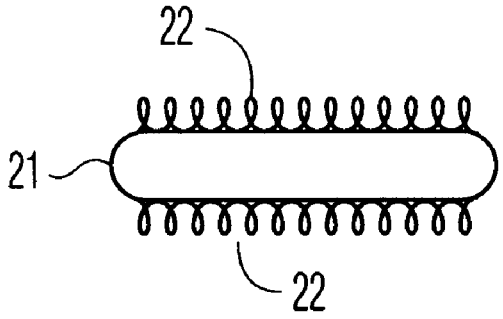
FIGS. 2A, 2B and 2C show side views of three types of playing piece according to a first embodiment of the present invention, having various combinations of hook and loop fastener material.
Figure 2B:
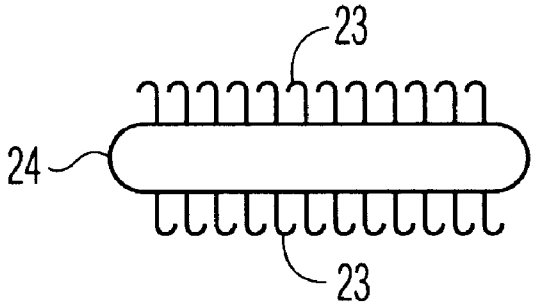
Figure 2C:
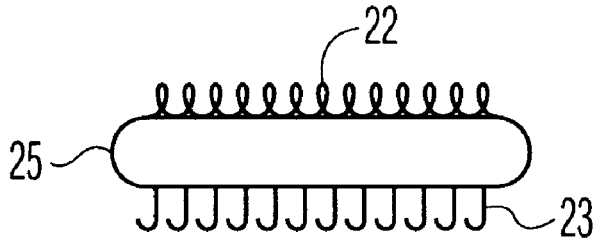
Figure 2D:
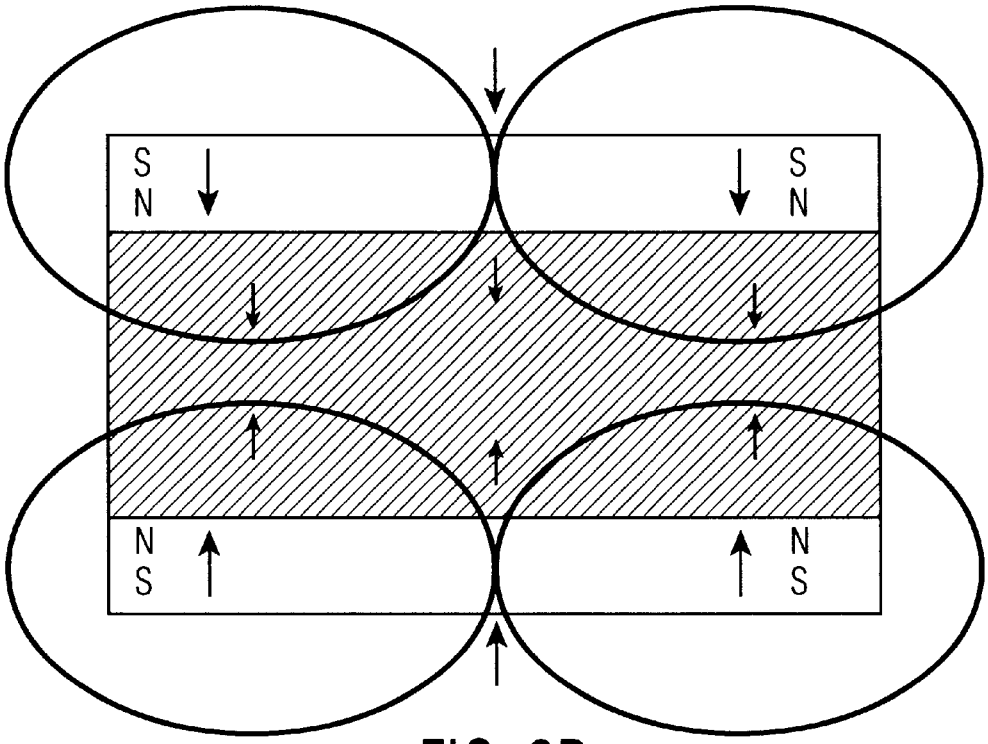
FIGS. 2D, 2E and 2F show side views of three types of playing piece according to a second embodiment of the present invention, having various polarity orientations of magnetic material.
Figure 2E:
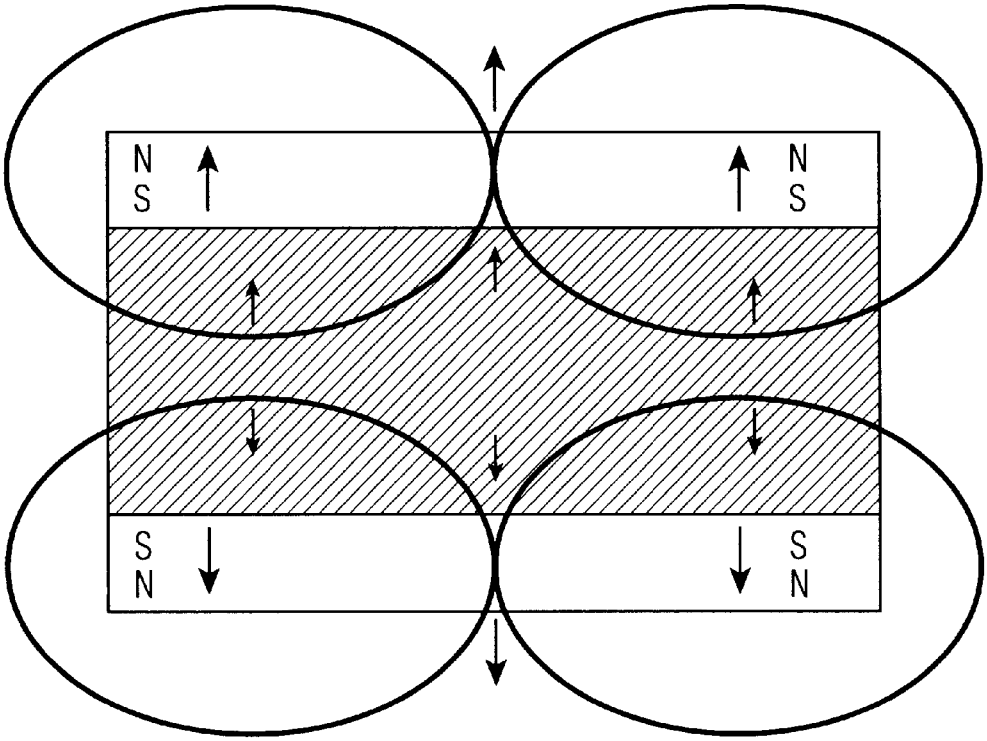
Figure 2F:
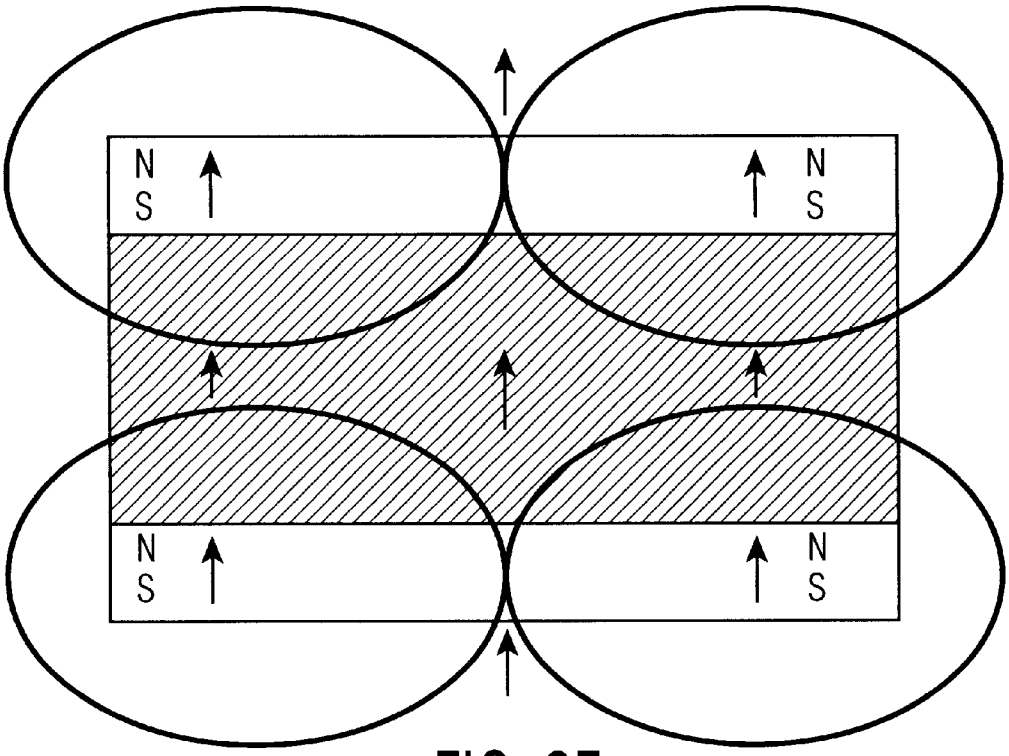

There are thus three types of pieces, of differing color and face color, including pieces 21 with both faces loop 22, as shown in FIG. 2A, pieces 24 with both faces hook 23, as shown in FIG. 2B, and pieces 25 with one face loop 22 and one face hook 23, as shown in FIG. 2C.

Game play is controlled by a cubic die 40, with two each of the numbers 1, 2, and 3 on its respective faces.

The object of the game is for a player to cover the board 6 with more of its color pieces 21, 24, 25 then the opponent, using as many of its pieces 21, 24, 25 as possible. In case of a tie, the player with the highest stack wins.

Each player starts by picking a color, black or white, and receives an equal number of pieces 21, 24, 25 of that selected color. Tan is a neutral color for both players. Game play requires stacking of playing pieces 21, 24, 25 such that hooks 23 attach to loops 22, and loops 22 attach to hooks 23.

One color, e.g., black, is arbitrarily assigned to go first. Each player, taking turns, rolls the die 40 to determine how many pieces 21, 24, 25 to move onto the board 6. Once a playing piece is deposited on the board 6 in an allowed position, it cannot be thereafter moved or removed during that game. A player cannot place more than two pieces (of any color) on any one stack during any one turn.

Tan playing pieces are placed on the board to covet up an opponent's color or to use up remaining pieces, during a turn.

The player with the greater number of its color pieces at the top of the stacks (on the board) at the end of the game wins. In case of a tie, the player with the highest stack of his/her color pieces wins. A game is also over when both players are unable to place any more pieces 21, 24, 25 on the board 6.

Figure 3:
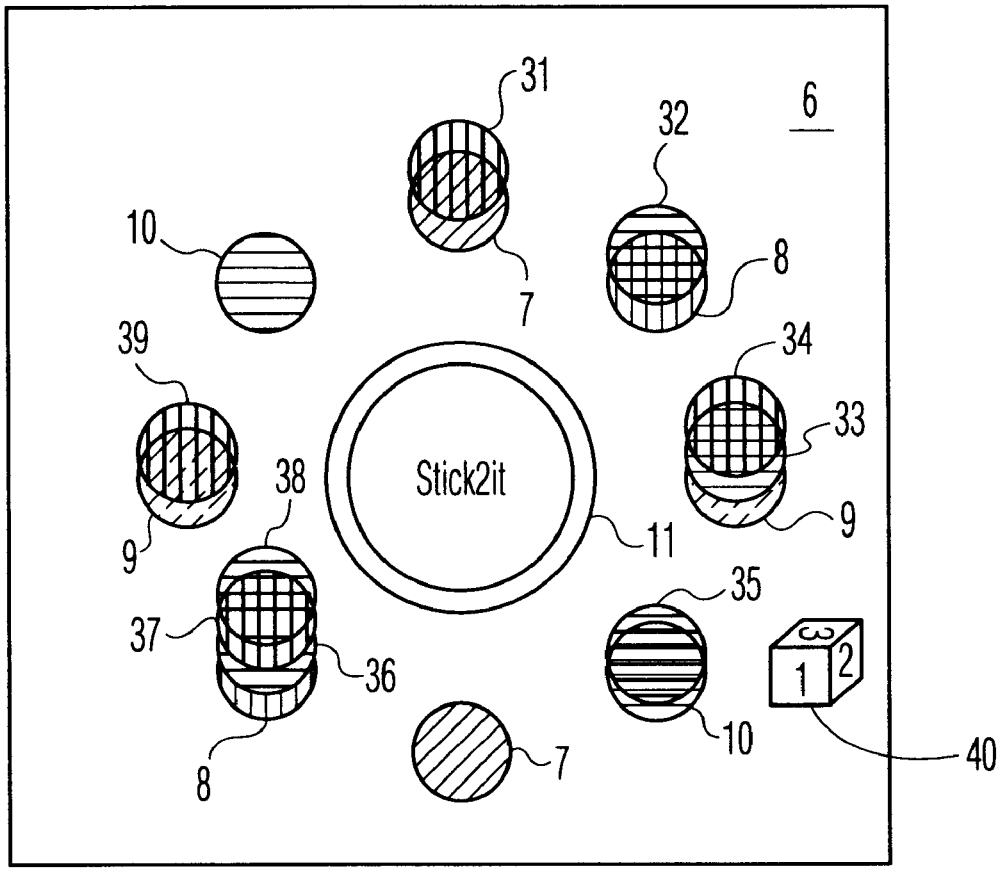
FIG. 3 shows a top view of an example game in progress, showing the selective stacking properties of the playing pieces.

As shown in FIG. 3, stacks grow by the sequential placement of pieces 31, 32, 33, 34, 35, 36, 37, 38, 39 on portions 7, 8, 9, 10 of the board 6 such that there is a selective adhesion therebetween. Portions 7, 8, 9, 10 may remain uncovered, or stacks 8, 36, 37, 38 may grow, such as shown in the lower left of FIG. 3.

When the case is closed, a graphic or graphics may appear anywhere on the outside of the package.

It is noted that colors of the disks 21, 24, 25 and the portions 7, 8, 9, 10 are a matter of choice and availability, and therefore other colors may be employed. It is also noted that the particular arrangement and set of associated game rules are not limiting to the invention, and therefore other games or game variants may be provided in accordance herewith.

EXAMPLE 2

A rectangular mat 50, formed of a fabric having protruding loops of thread is provided. A set of game elements 50, 51, 52, 53, 54, 55, typically having graphic symbols printed or formed thereon, are selectively placed at locations on the mat 50, which locations may be arbitrary or predefined, or which may be varied during the course of the game play. These hooks and loops of the mat 50 and game elements 50, 51, 52, 53, 54, 55, are compatible, i.e., will adhere under a small amount of pressure. In the event that additional game playing elements are provided, the upper surface of the game elements 50, 51, 52, 53, 54, 55, may employ two different types of hook and/or loop material, for example one disposed surrounded by the other, with, for example, the outer region incompatible with the normal hook and loop fastener material of the additional playing elements. It is preferred in such a case, that the loop material of the mat 50 has a low probability of statistical interaction with hook material of the additional playing pieces, for example because of increased loop size and/or thread diameter.

Each of the game elements 50, 51, 52, 53, 54, 55, has on its face normal hook 23 or loop 22 material, through which the graphic elements are visible. Game pieces, as discussed above, are provided, having hook 23 and/or loop 22 material disposed on respective faces, and additionally with color or graphic coding. In this case, the object of the game is to control territory on the mat 50 (game board) while gaining "wealth", which may represent economic value or other values. Players sequentially place and/or move their playing pieces based on a set of rules defining three dimensional interactions, "wealth" transfers, and optionally a random-element, such as a set of dice. As discussed above, permissible moves are defined, at least in part, by an appropriate adhesion property between polarized adhesion material.

Figure 4:
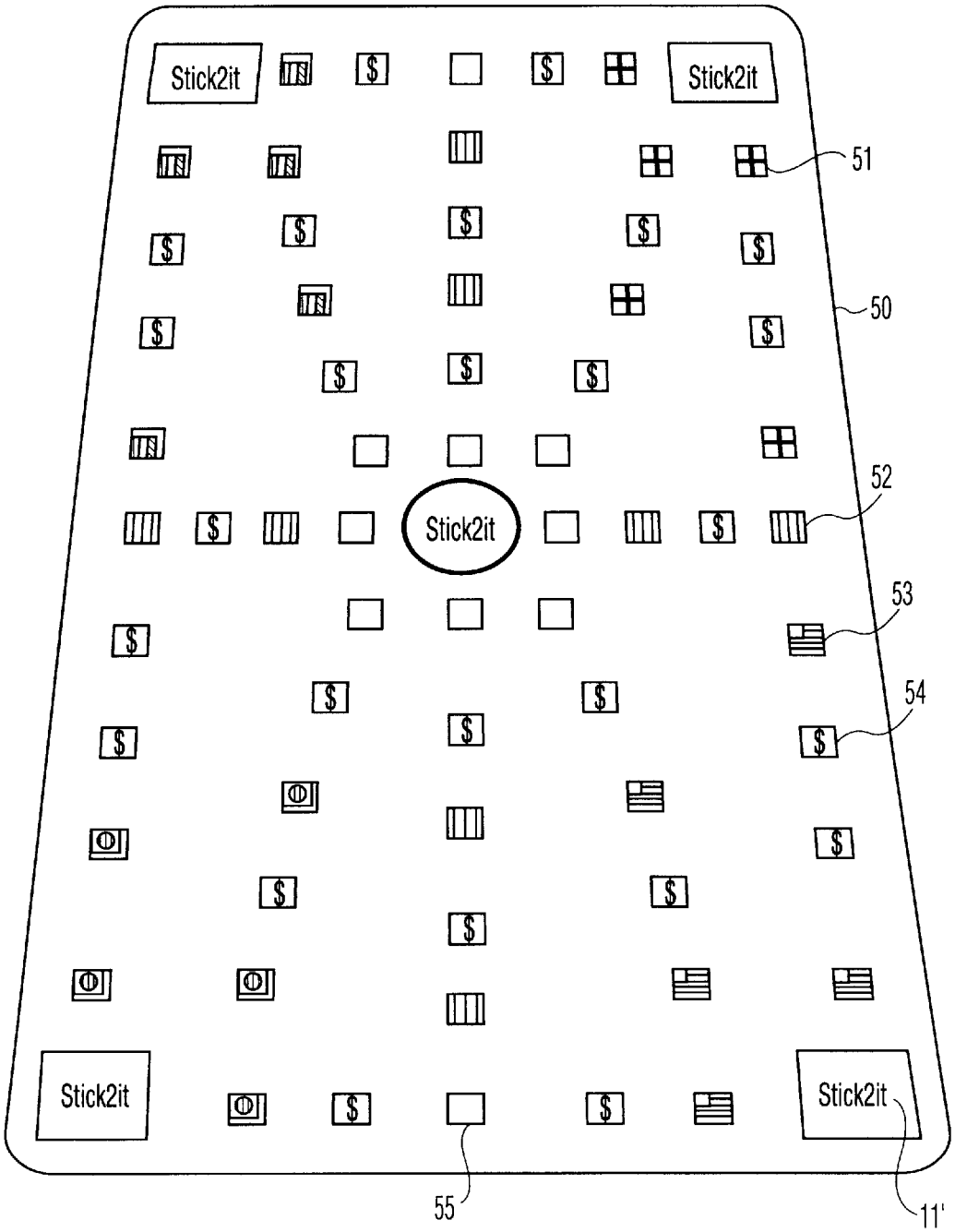
FIG. 4 shows a perspective view of an alternate embodiment of a playing board according to the present invention.
Figure 5:
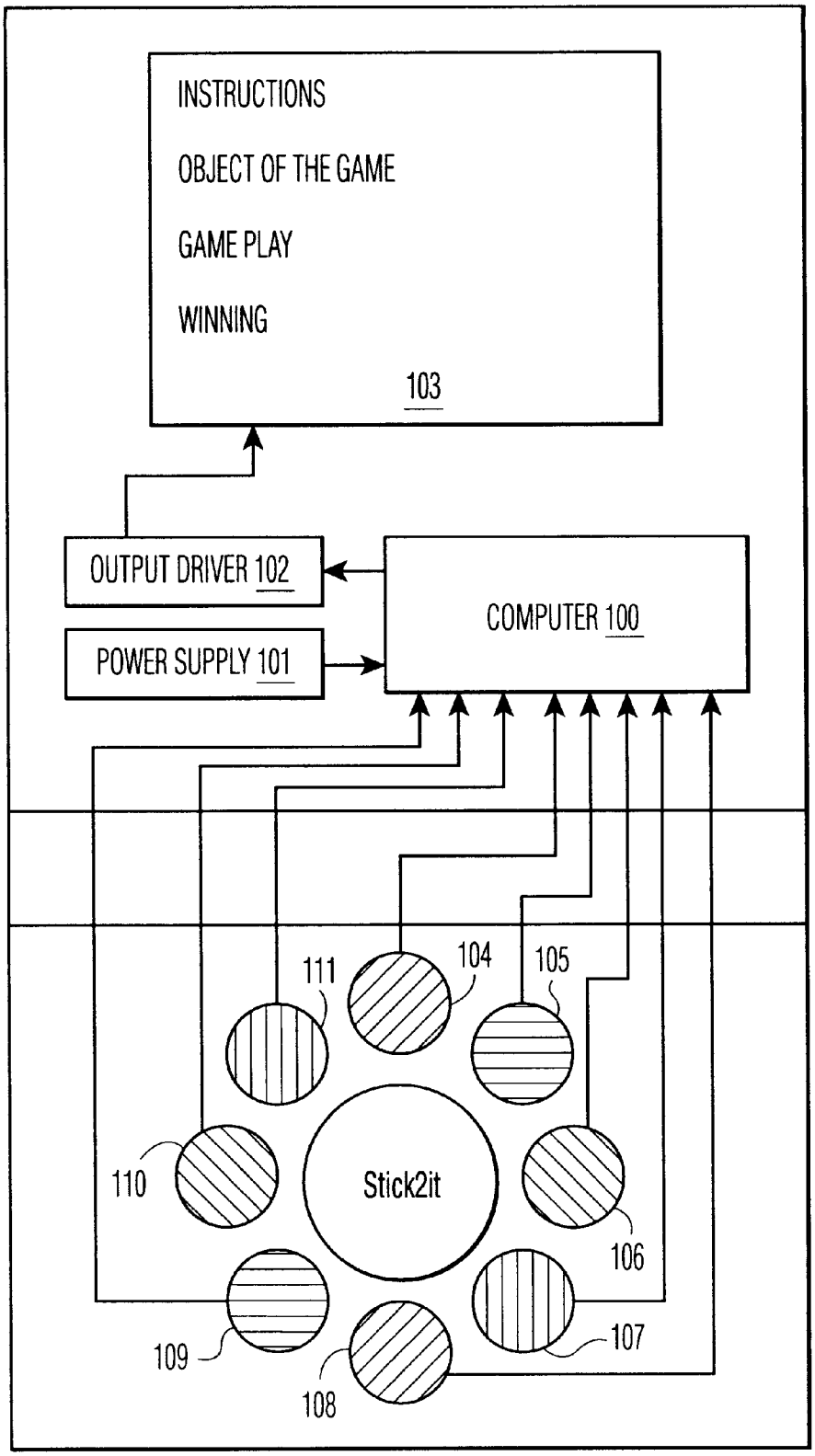
FIG. 5 shows a computer game embodiment of the present invention having a physical game board.
Figure 6:
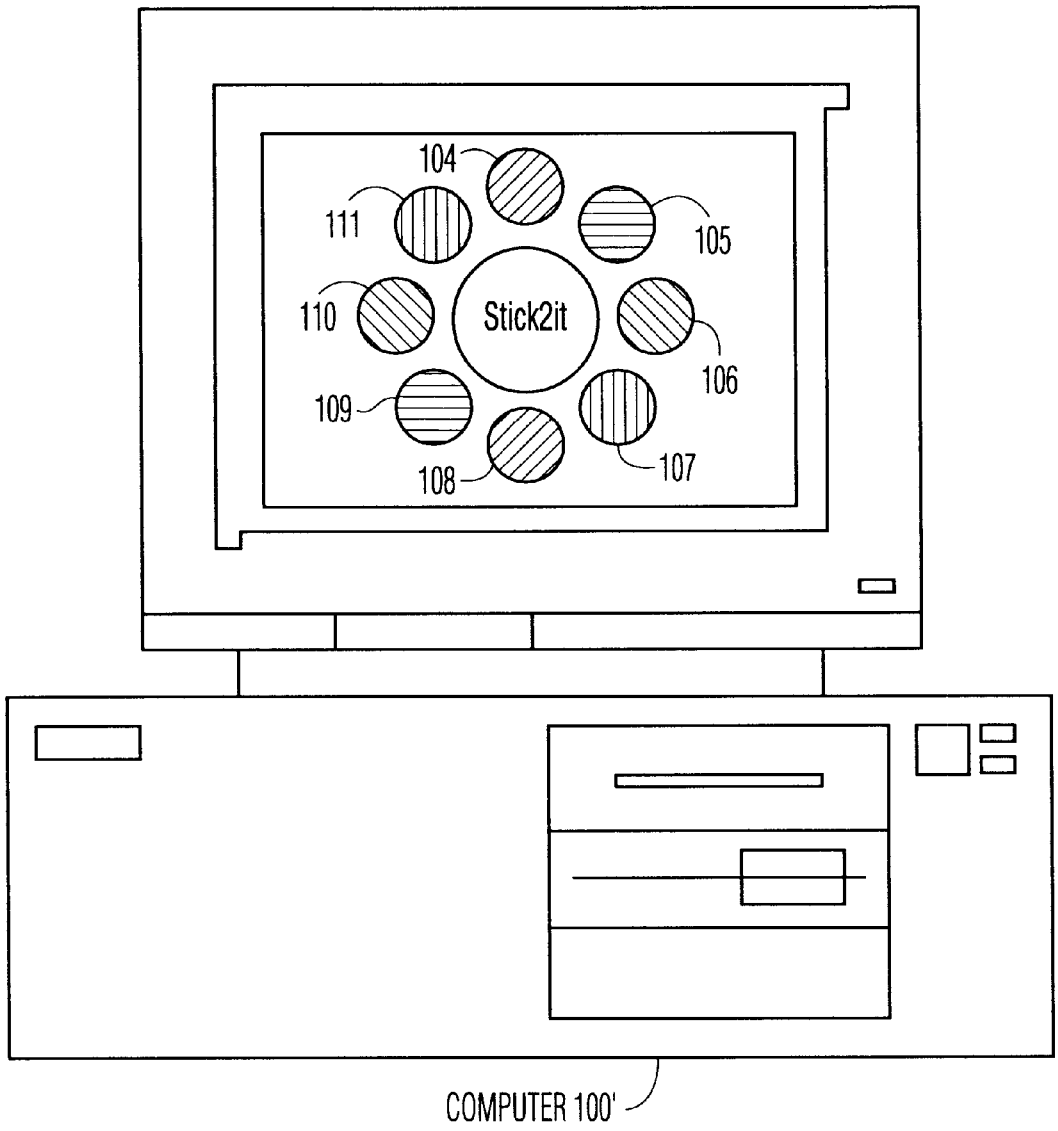
FIG. 6 shows a computer game embodiment of the present invention having a virtual game board.

The mat 50 may have contiguous zones of game elements 50, 51, 52, 53, 54, 55, or these may sparsely populate the area of the mat 50, as shown in FIG. 4. The mat 50 may also have graphic zones delineated (not shown in FIG. 4), in order to assist players in defining game element positions and compliance with rules. The mat 50 may also have static graphics 11', representing trademarks and licensed elements.

As an additional element, a playing piece with a smooth surface (neither hook nor loop) may be provided, defining a terminator, stopping further increases in height of a stack.

While the above detailed description has shown, described and pointed out the fundamental novel features of the invention as applied to various embodiments, it will be understood that various omissions and substitutions and changes in the form and details of the system and method illustrated may be made by those skilled in the art, without departing from the spirit of the invention. Consequently, the full scope of the invention should be ascertained by the appended claims.

What I claim is:

1. A game having a board and playing pieces, comprising:

a plurality of polarized adhesion portions on a surface of said board;

a plurality of game pieces, each having at least two surfaces, each surface having a compatible or incompatible polarity with a respective polarized adhesion portion on said surface of said board, wherein a game piece having a compatible adhesion portion with a respective portion on said surface of said board will adhere thereto and a game piece having an incompatible adhesion portion with a respective portion on said surface of said board will not adhere thereto, and wherein at least one game piece has two faces representing a same polarity.

2. The game according to claim 1, wherein said playing pieces are color coded.

3. The game according to claim 1, wherein said polarized adhesion portions comprises hook and loop-type fastener material.

4. The game according to claim 1, wherein said polarized adhesion portions comprise magnetized domains.

5. The game according to claim 1, wherein said game pieces are adapted to mutually adhere when faces having opposite polarization are adjacent.

6. The game according to claim 1, wherein a player strategically places a game piece on said board.

7. The game according to claim 1, wherein a conduct of play is controlled by a random factor.

8. The game according to claim 1, wherein a conduct of play is controlled by a roll of a die.

9. The game according to claim 1, wherein said board comprises a self-contained enclosure for said game pieces.

10. The game according to claim 1, wherein said plurality of polarized adhesion portions on said surface of said board has a predetermined configuration.

11. The game according to claim 1, wherein said plurality of polarized adhesion portions on said surface of said board has a configuration which varies between different game patterns.

12. The game according to claim 1, wherein said plurality of polarized adhesion portions on said surface of said board has a configuration pattern which varies during game play.

13. The game according to claim 1, wherein each game piece comprises a disk having a hook and loop fastener portion on both surfaces.

14. The game according to claim 1, wherein game pieces are provided with two surfaces of each respective polarity and with both respective polarities.

15. The game according to claim 1, wherein each surface of each game piece is color coded.

16. The game according to claim 1, wherein said board comprises an electronic device for sensing a status of said board.

17. The game according to claim 1, wherein said board and said game pieces are virtual constructs implemented on a computer system.

18. The game according to claim 1, wherein said game pieces comprise a graphic element on a surface thereof.

19. The game according to claim 1, wherein said game pieces comprise a graphic element on a surface thereof, said graphic being independent of game play.

20. The game according to claim 1, wherein said game pieces comprise a graphic element on a surface thereof, said graphic defining a conduct of game play.

21. A method of playing a game having a board and playing pieces, comprising:

providing a plurality of polarized adhesion portions on a surface of said board;

providing a plurality of game pieces, each having at least two surfaces, each surface having a compatible or incompatible polarity with a respective polarized adhesion portion on said surface of said board, wherein a game piece having a compatible adhesion portion with a respective portion on said surface of said board will adhere thereto and a game piece having an incompatible adhesion portion with a respective portion on said surface of said board will not adhere thereto, and wherein at least one game piece has two faces representing a same polarity;

placing a first game piece having two faces representing a same polarity on a compatible adhesion portion; and stacking a second game piece having a compatible adhesion portion with respect to said polarity of said adhesion portion on said face of said first game piece on said first game piece.

22. A game comprising a surface having thereon a polarized adhesion portion having an adhesion polarity; and a plurality of pieces, each piece having two faces, each face having a polarized adhesion portion, said pieces including at least one piece having faces of a single adhesion polarity and at least one piece having faces of two different adhesion polarities.

23. The game according to claim 22, wherein said surface is provided thereon with a plurality of portions, at least one each of different adhesion polarities.

24. The game according to claim 22, wherein said adhesion polarities are selected from the group consisting of hook-type and loop type hook and loop fastener materials.

25. The game according to claim 22, wherein said pieces are color coded.

26. The game according to claim 22, wherein a face of a piece is color coded.

27. The game according to claim 22, wherein a polarized adhesion portion is color coded.

28. A method for using a system including a surface having thereon a polarized adhesion portion having an adhesion polarity; and a plurality of pieces, each piece having two faces, each face having a polarized adhesion portion, the pieces including at least one piece having faces of a single adhesion polarity and at least one piece having faces of two different adhesion polarities, comprising the steps of:

placing a first piece on a polarized adhesion portion of the surface such that the piece selectively adheres to the portion; and placing a second piece on a free face of the first piece such that the second piece selectively adheres to the face of the first piece.

29. The method according to claim 28, wherein the surface is provided thereon with a plurality of portions, at least one each of different adhesion polarities.

30. The method according to claim 28, wherein the adhesion polarities are selected from the group consisting of hook-type and loop type hook and loop fastener materials.

31. The method according to claim 28, wherein the pieces are color coded.

32. The method according to claim 28, wherein a face of a piece is color coded.

33. The method according to claim 28, wherein a polarized adhesion portion is color coded.

34. The method according to claim 28, wherein said system is a game system, wherein the portions and faces of the pieces are color coded, and wherein at least four pieces are provided, further comprising the step of stacking pieces such that each piece selectively adheres to the adjacent portions and adjacent other pieces.

* * * * *